United States Patent [19]

Bauch

[11] Patent Number: 4,528,880

[45] Date of Patent: Jul. 16, 1985

[54] STAPLE FIBER CUTTING MACHINE

[75] Inventor: Ernst Bauch, Bordesholm, Fed. Rep. of Germany

[73] Assignee: Neumünstersche Maschinen-und Apparatebau Gesellschaft mbH (Neumag), Neumuenster, Fed. Rep. of Germany

[21] Appl. No.: 351,739

[22] Filed: Feb. 24, 1982

[30] Foreign Application Priority Data

Mar. 4, 1981 [DE] Fed. Rep. of Germany ..... 3108096

[51] Int. Cl.[3] ..... B26D 7/06; D01G 1/00; D01G 37/00

[52] U.S. Cl. ..... 83/411 R; 83/913; 19/0.3; 19/0.6; 19/0.62; 19/0.64

[58] Field of Search ..... 19/0.6, 0.62, 0.64, 19/0.3; 83/913, 411 R, 13

[56] References Cited

U.S. PATENT DOCUMENTS

| | | | |
|---|---|---|---|
| 3,062,082 | 11/1962 | Keith | 83/913 X |
| 4,014,231 | 3/1977 | Hutzezon | 83/913 X |
| 4,343,069 | 8/1982 | McLuskie et al. | 83/913 X |

*Primary Examiner*—Paul A. Bell
*Assistant Examiner*—Taylor J. Ross
*Attorney, Agent, or Firm*—Michael J. Striker

[57] ABSTRACT

A staple fiber cutting machine has a cutter supporting member which supports a plurality of cutters and is driven in rotation by a drive, a gap formed so that a cable can be introduced into the gap, and a pressing member which is driven in rotation during idle running of the machine, prior to introduction of a cable into the gap. The machine works so that not only the cutter supporting member rotates, but also the pressing member rotates during the starting phase or the idle running of the machine.

5 Claims, 2 Drawing Figures

STAPLE FIBER CUTTING MACHINE

BACKGROUND OF THE INVENTION

The present invention relates to a staple fiber cutting machine, particularly for continuously cutting cables of synthetic fibers.

Staple fiber cutting machines are known in the art. One such machine is disclosed, for example, in the German Offenlegungsschrift No. 2,939,154.6-26. The machine disclosed in this reference has a rotary cutter supporting member provided with a plurality of cutters and driven by a motor. A pressing member provided in this machine does not have its separate drive. The pressing member is taken along in rotation by a friction because it rolls over a coil which in stationary operation is arranged on a coil core. In this manner, the rotary speed of the pressing member is automatically brought into correspondence with the rotary speed of the cutter supporting member, so that no sliding movement takes place between the cable and the pressing member. As a result of this, the sliding friction in stationary operation is completely excluded. Thus, however, is not true for the phase of starting the machine. During machine starting, the cutter supporting member first has a rotary speed. Since no coil is available, the pressing member remains stationary. Only after insertion of the cable does the coil start to form and the pressing member is accelerated from its stationary position to the working speed. At this time, a strong sliding friction similar to the sliding friction in a friction coupling takes place during a short time. In the event of high speed the heat generation can be so great that the fiber material softens and frits. Thereby the start of the process can be made more difficult or completely impossible.

This problem basically takes place also in a staple fiber cutting machine in accordance with U.S. Pat. No. 4,014,231. However, it arises here with an especially great intensity, inasmuch as this machine is simplified in desired manner as compared with the known machines, in the angular region in which the pressing member is in contact with the coil. Thereby the action of the friction is greater and the cooling by surrounding atmosphere is lower than in the conventional machines.

Another staple fiber cutting machine is disclosed in U.S. Pat. application Ser. No. 341,161, filed Jan. 19, 1982.

SUMMARY OF THE INVENTION

Accordingly, it is an object of the present invention to provide a staple fiber cutting machine which avoids the disadvantages of the prior art.

More particularly, it is an object of the present invention to provide a staple fiber cutting machine in which during starting of the machine no sliding friction develops in the coil and the pressing member.

In keeping with these objects, and with others which will become apparent hereinafter, one feature of the present invention resides, briefly stated, in a staple fiber cutting machine having a rotary cutter supporting member provided with a plurality of cutters and having drive means for driving the same into rotation, and a pressing member cooperating with the cutter supporting member, wherein drive means for driving the pressing member in rotation during idle running of the machine is provided.

When the staple fiber cutting machine is designed in accordance with the present invention, it avoids the disadvantages of the prior art. More particularly, the pressing member can be driven in rotation when the coil is not available. Since the pressing member is brought in rotation with the same rotary speed as the cutter supporting member, the above-mentionedsliding movement during the starting phase is avoided.

The invention is especially important and advantageous in combination with a staple fiber cutting machine disclosed in the German Offenlegungsschrift P No. 2,939,154.6-26. However, it can also be utilized with other staple fiber cutting machines.

In accordance with another feature of the present invention, the drive means for driving the pressing member in rotation is formed as an additional motor. In this construction the pressing member rotates independently of the rotation of the cutter supporting member.

Still another feature of the present invention is that the machine has means for transmitting rotation from the additional motor to the pressing member, which means includes a friction belt driven by the additional motor and engaging the peripheral surface of the pressing member.

Yet another feature of the present invention resides in the fact that the pressing member can be uncoupled from the additional motor.

A further feature of the present invention is that the drive means for the pressing member may include a rotation-transmitting means arranged for transmitting rotation between the cutter supporting member and the pressing member, so that when the cutter supporting member rotates the pressing member is rotated together with the latter. In this construction, it is not necessary to provide an additional motor for the pressing member.

The rotation-transmitting means, in accordance with still a further feature of the present invention, may be provided on at least one of the pressing member and cutter supporting member and be formed by magnets. The magnets can also be arranged on both pressing member and cutter supporting member.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
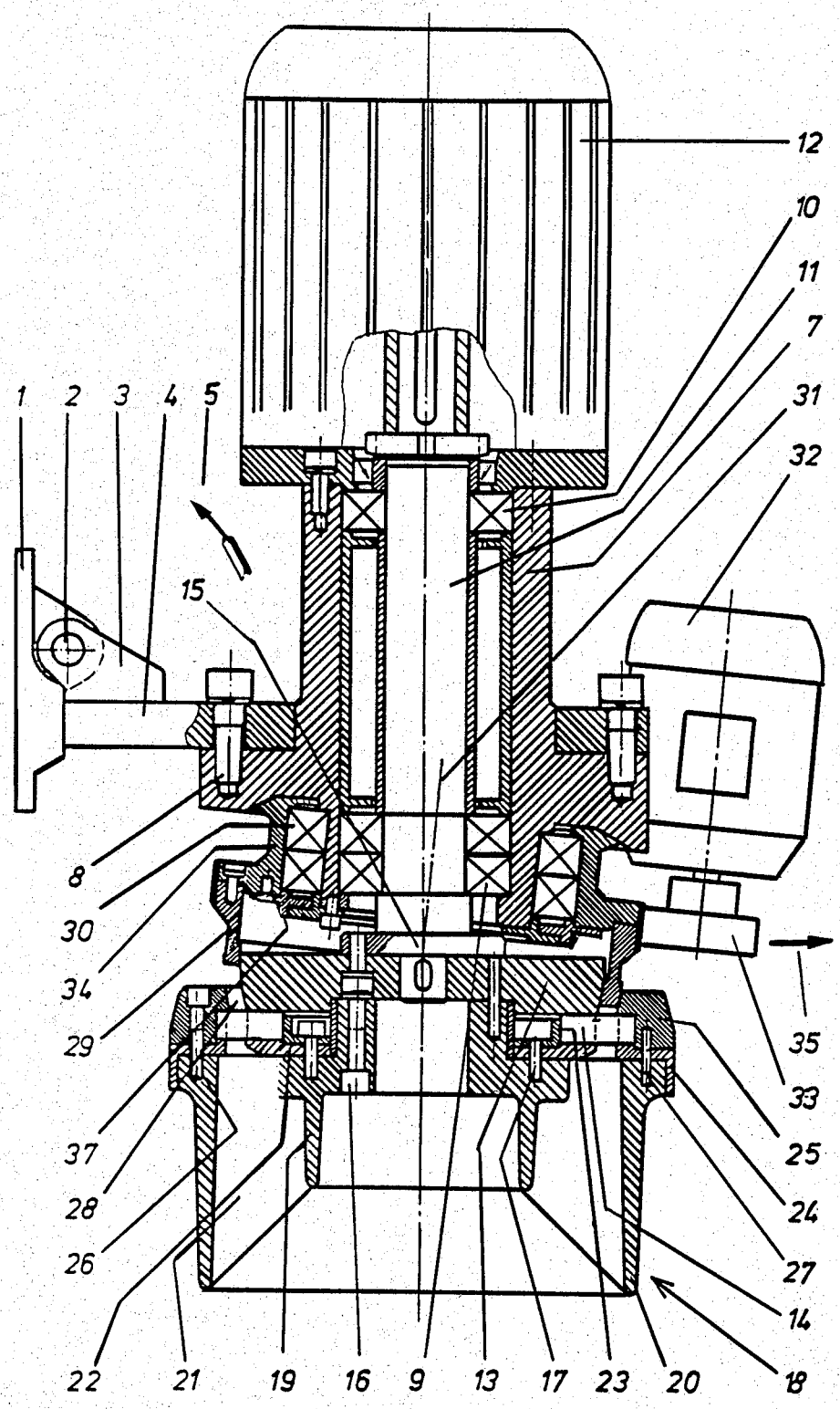
FIG. 1 of the drawing is a view showing a section of a staple fiber cutting machine in accordance with one embodiment of the present invention.

A staple fiber cutting machine has a stationary machine frame identified by reference numeral 1 and shown only partially. A plate 4 is mounted on the frame 1 with the aid of a pivot pin 2 and an ear 3. The plate 4 can be turned from the shown horizontal operational position in direction of the arrow 5 about substantially 90°.

A cylindrical bearing housing 7 is arranged in an opening of the plate 4 and has a collar-shaped portion connected by screws 8 with the plate 4. A shaft 11 is supported in the housing 7 with the aid of bearings 9 and 10. The shaft 11 is driven by a motor 12 mounted via a flange on the upper end of the housing 7. The shaft 11 has a lower portion on which a cutter supporting member 13 is mounted. Cutters 14 extend radially outwardly beyond the cutter supporting member 13. The cutters 14 have cutting edges facing upwardly. The peripheral face of the cutter supporting member 13 in the region above the plane of the cutter edges of the cutters is formed as a spherical zone. A central point 15 of this sphere corresponds to the central point of the upper end face of the cutter supporting member 13.

An element 18 is mounted on the cutter supporting member 13 by at least one screw 16 and pins 17. The element 18 includes a ring-shaped hub 19, a drum 20 surrounding the hub 19 and coaxial therewith, and three spokes 21 which connect the hub 19 with the drum 20 and are spaced from one another in a circumferential direction by uniform angular distances of 120°.

A ring 22 is arranged between the hub 19 and the cutter supporting member 13 and provided with, for example, twenty-seven radial slots uniformly distributed over its periphery. Inner ends of the cutters 14 are inserted into the slots of the ring 22. A supporting ring 23 secures the cutters 14 in their radial positions. On the upper end face of the drum 20, a ring 24 forming a counterpiece for the ring 22 extends in the same plane and has respective radial slots for receiving outer ends of the cutters 14. The ring 24 is arranged between the drum 20 and a further ring 25 which is connected by screws 26 and pins 27 fixedly to the drum 20. The ring 25 overlaps the outer edges of the cutters like a covering cap.

The ring 25 has an inner face facing toward the spherical face of the cutter supporting member 13 and forming a concentric hollow spherical zone. An annular passage 28 is formed therebetween. A pressing ring 29 is rotatably mounted via an inclined bearing 30 about an axis 31 which is inclined to a geometrical axis of the shaft 11 and intersects the latter in a center point of the sphere 15. The pressing ring 29 extends at the right side of the drawing into the annular gap 28 with a small lateral play to a region of the cutting edges of the cutters. At the left side, a slot remains because of the above-mentioned inclined position, for a tangentially introducible cable. At least in the vicinity of the end face facing toward the cutters 14, the outer face and the inner face of the pressing ring 29 corresponds to the spherical lateral limiting faces of the annular gap 28.

As shown in FIG. 1, a motor 32 is mounted by a not shown mounting means on the plate 4. Its geometrical axis is parallel to the axis 31 of the pressing ring 29. A friction wheel 33 is arranged on the shaft of the motor and engages with the peripheral surface of the pressing ring 29 and a bearing ring 34 on which the pressing ring 29 is mounted. The motor 32 is turnable in direction of the arrow 35 about an axis extending in the plane of the drawing and arrestable in the turned position. In this position the pressing member 29 can be uncoupled from the motor 32.

Prior to switching on of the machine to the operation the motor 32 is brought with the friction wheel 33 to a position shown in the drawing. The motor 32 is switched on, so that with the switched on motor 12 the pressing ring 29 rotates with a rotary speed equal to the rotary speed of the cutter supporting member 13. The relative speed between the pressing ring 29 and the cutter supporting member 13 is thereby practically equal to zero in the circumferential direction. When a cable is introduced into the annular passage 28, the cable is engaged at all sides with the same speed. The damaging sliding friction between the cable and the pressing ring 29 does not take place. As soon as the quantity of threads characteristic for the stationary operation are located in the annular passage 28, the pressing ring 29 is taken along by the friction which occurs between the pressing ring 29 and the coil. The motor 32 with the friction wheel 33 can be turned in the direction of the arrow 35 and switched off.

Figure 2:
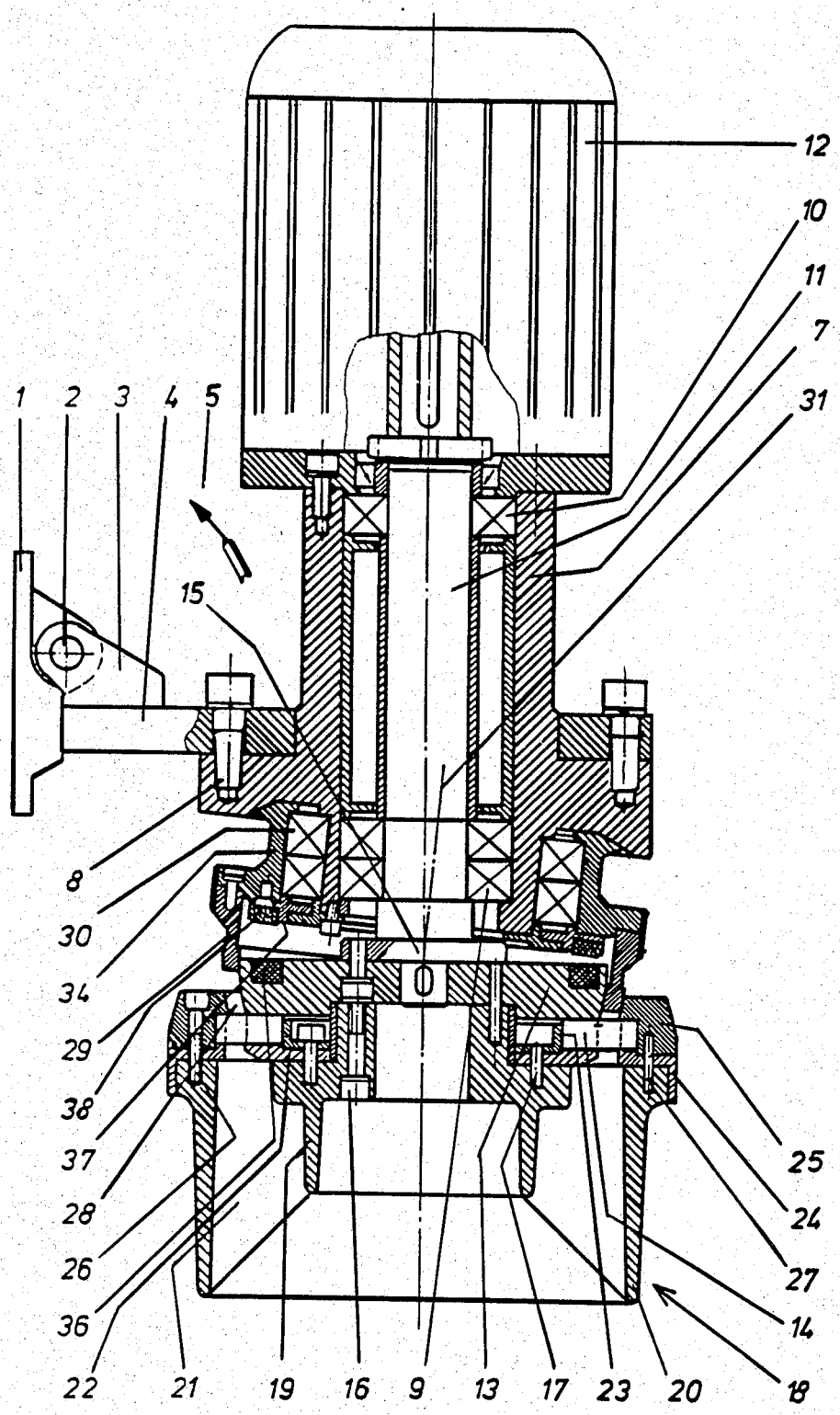
FIG. 2 is a view showing a section of the inventive machine in accordance with another embodiment.

A further embodiment of the machine in accordance with the present invention is shown in FIG. 2. In accordance with this embodiment, the motor with the friction wheel is dispensed with. An upper end face of the cutter supporting member 13, as seen in the drawing, is provided with several magnets 36 which are shown schematically. The magnets 36 are located in the vicinity of the periphery of the cutter supporting member 13 and spaced from one another by equal angular distances. The ring 37 is fixedly mounted by screws on the lower side of the bearing ring 34 and serves for accommodating a bearing 30. The ring 37 is provided with counterpieces 38 of ferromagnetic material. It is to be understood that, in dependence upon the shape and arrangement of the magnets 36 and the counterpieces 38, the cutter supporting member 13 and/or the ring 37 can be composed completely or partially of a non-ferromagnetic material.

When the machine is designed in accordance with the second embodiment, the pressing member 29 is driven in rotation under the action of the magnets during the start of the machine brought to the rotary speed of the cutter supporting member 13. As soon as the stationary (stable) operational condition is attained, the action of the magnets is of no importance.

It will be understood that each of the elements described above, or two or more together, may also find a useful application in other types of constructions differing from the types described above.

While the invention has been illustrated and described as embodied in a staple fiber cutting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A staple fiber cutting machine for continuously cutting cables of synthetic fibers, comprising a rotation-symmetrical rotary cutter supporting member having an outer surface and an axis and rotatable with a predetermined speed; drive means for driving said cutter supporting member in rotation; a plurality of cutters provided with cutting edges, distributed over a periphery of said cutter supporting member, and having end portions extending outwardly beyond the latter; a ring member mounted on said end portions of said cutters and forming together with said outer surface of said cutter supporting member an annular passage, said ring member having an outlet side; a pressing member extending at one portion of its periphery into said annular passage with lateral play and to said cutting edges of said cutter, and forming at another portion of its periphery an inlet slot for introduction of a cable, said pressing member being rotatable about an axis which is inclined to said axis of said cutter supporting member and with a speed substantially corresponding to said speed of the latter; a drum member mounted on said outlet side of said ring member and having an inner diameter substantially corresponding to an inner diameter of said ring member, and a length at least substantially equal to a distance between said cutting edges of two neighboring ones of said cutters; and further drive means connectable with said pressing member during idle running of the machine so as to drive said pressing member in rotation during the idle running, and disconnectable from said pressing member during normal operation of the machine.

2. A machine as defined in claim 1, wherein said further drive means is arranged to drive said pressing member in rotation prior to introduction of a cable into said inlet slot.

3. A machine as defined in claim 1, wherein said further drive means for driving said pressing member in rotation includes an additional motor.

4. A machine as defined in claim 3, wherein said pressing member has a peripheral surface; and further comprising means for transmitting rotation from said additional motor to said pressing member and including a friction wheel driven by said additional motor and engaging said peripheral surface of said pressing member.

5. A machine as defined in claim 3, wherein said additional motor and said pressing member are arranged so that said pressing member can be uncoupled from said additional motor.

* * * * *